US008931412B2

(12) United States Patent
Bernsdorf et al.

(10) Patent No.: US 8,931,412 B2
(45) Date of Patent: Jan. 13, 2015

(54) METHOD FOR PRINTING OF A RECORDING

(75) Inventors: Astrid Bernsdorf, Feldkirchen (DE); Claudia Schäfle, Feldkirchen (DE); Martin Berg, München (DE)

(73) Assignee: Océ Printing Systems GmbH, Poing (DE)

( * ) Notice: Subject to any disclaimer, the term of this patent is extended or adjusted under 35 U.S.C. 154(b) by 692 days.

(21) Appl. No.: 13/150,369

(22) Filed: Jun. 1, 2011

(65) Prior Publication Data

US 2011/0256478 A1 Oct. 20, 2011

(30) Foreign Application Priority Data

Mar. 1, 2004 (DE) ..... 10 2004 009 986

(51) Int. Cl.
*G03G 13/20* (2006.01)
*G03G 9/125* (2006.01)

(52) U.S. Cl.
CPC ..... *G03G 9/125* (2013.01); *G03G 13/20* (2013.01)
USPC ..... 101/491; 399/237; 399/67; 399/97

(58) Field of Classification Search
None
See application file for complete search history.

(56) References Cited

U.S. PATENT DOCUMENTS

| | | | | |
|---|---|---|---|---|
| 4,130,599 | A | 12/1978 | Merrill et al. | |
| 6,737,287 | B1 | 5/2004 | Furuse et al. | |
| 2002/0081515 | A1 | 6/2002 | Tsubuko et al. | |
| 2004/0009093 | A1 * | 1/2004 | Grunwald et al. | 422/26 |
| 2004/0136874 | A1 * | 7/2004 | Klimant et al. | 422/99 |

FOREIGN PATENT DOCUMENTS

| | | | |
|---|---|---|---|
| EP | 0 455 343 | A1 | 11/1991 |
| EP | 0 455 343 | B1 | 11/1991 |
| EP | 0 727 720 | B1 | 12/2000 |
| EP | 0 756 213 | B1 | 12/2002 |
| JP | 6-236078 | A | 8/1994 |
| JP | 2000-309734 | A | 11/2000 |
| JP | 2002-006738 | A | 1/2002 |
| JP | 2003-057883 | A | 2/2003 |

* cited by examiner

*Primary Examiner* — Joshua D Zimmerman
(74) *Attorney, Agent, or Firm* — Schiff Hardin LLP

(57) ABSTRACT

In a method or system for printing of a recording medium, potential images of images to be printed are generated on a potential image carrier. The potential images are developed into an image film comprising image regions and non-image regions on the potential image carrier via application of a liquid developer comprising a polymerizable carrier fluid with dye particles suspended therein. The image film is transferred onto the recording medium. The image film is fixed on the recording medium via a cross-linking reaction of the carrier fluid such that the dye particles of the image regions are embedded in a fixed polymer matrix and the carrier fluid hardens into a transparent film that permanently bonds with the recording medium. The cross-linking reaction of the carrier fluid is started, accelerated, or extended by at least one component.

20 Claims, 1 Drawing Sheet

104
103
200
102
202
201
101
203
105
204
302
301
402
401

501
500
502

504
503
505
402

506
500

504
503
505
402

METHOD FOR PRINTING OF A RECORDING

RELATED APPLICATION

The present application is a division of U.S. Ser. No. 10/589,683 filed Apr. 15, 2008 now abandoned titled "METHOD FOR PRINTING OF A RECORDING", inventors—Astrid Bernsdorf, et al.

BACKGROUND

For single- or multi-color printing of a recording medium, for example of a single sheet or of a belt-shaped recording medium made from the most varied materials (for example plastic, paper or thin metal films), it is known to generate image-dependent potential images (charge images) on a potential image carrier (for example a photoconductor), to ink these potential images in a developer station (inking station) and to transfer-print the image so developed onto the recording medium.

Either dry toner or liquid developer can thereby be used to develop the potential images.

A method for electrophoretic liquid development electrophotographic developing) in digital printing systems is, for example, known from EP 0 756 213 B1 or EP 0 727 720 B1. The method described there is also known under the name HVT (high viscosity technology). A carrier fluid comprising silicone oil with ink particles (toner particles) dispersed therein is thereby used as a developer fluid. The toner particles typically have a particle size of less than 1 micron. Something close to this can be learned from EP 0 756 213 B1 or EP 0 727 720 B1, which are components of the disclosure of the present application. Described there are electrophoretic liquid developing methods of the cited type with silicone oil with toner particles dispersed therein as a carrier fluid and additionally a developer station made up of one or more application rollers for wetting the potential image carrier with liquid developer corresponding to the potential images on the potential image carrier. The developed potential image is then transferred onto the recording medium via one or more transfer rollers.

In order to secure the toner images in the recording medium, these are fixed there. Previous liquid developer methods are based on a high-ohmic carrier fluid and solid particles (toner particles) suspended therein with a preferential charge.

Given use of a volatile carrier fluid the fixing occurs via evaporation of the carrier fluid and simultaneous fusing of the toner particles under heat effect. The resins of the toner particles adhere with one another and with the recording medium.

Given use of a non-volatile carrier fluid, for example silicone oil, the fixing occurs via reduction of the carrier fluid on the surface of the recording medium and via the simultaneous fusing of the toner particles under heat effect. The reduction of the carrier fluid thereby occurs via, among other things, suction in the recording medium and/or via conditioner rollers that run on the unfixed print image and thereby absorb carrier fluid.

A liquid developer with a hardenable carrier fluid is known from EP 0 455 343 A1. the bonding of the images to be printed with a recording medium occurs via curing of the carrier fluid, whereby a chemical reaction is implemented for curing. The carrier fluid can comprise dimethyl-siloxane bonds. The carrier fluid can additionally comprise a cross-linking agent whose proportion in the carrier fluid can be up to 100%. The curing of the carrier fluid can be initiated by a starter agent.

SUMMARY

An object is to specify a method with which the fixing with liquid developer becomes largely independent of the properties of the recording medium and can be specifically controlled corresponding to its properties. Furthermore, the fixing should also be independent of the carrier substance of the color pigment (toner particles).

In a method or system for printing of a recording medium, potential images of images to be printed are generated on a potential image carrier. The potential images are developed into an image film comprising image regions and non-image regions on the potential image carrier via application of a liquid developer comprising a polymerizable carrier fluid with dye particles suspended therein. The image film is transferred onto the recording medium. The image film is fixed on the recording medium via a cross-linking reaction of the carrier fluid such that the dye particles of the image regions are embedded in a fixed polymer matrix and the carrier fluid hardens into a transparent film that permanently bonds with the recording medium. The cross-linking reaction of the carrier fluid is started, accelerated, or extended by at least one component.

DESCRIPTION OF A PREFERRED EMBODIMENT

Figure 1:
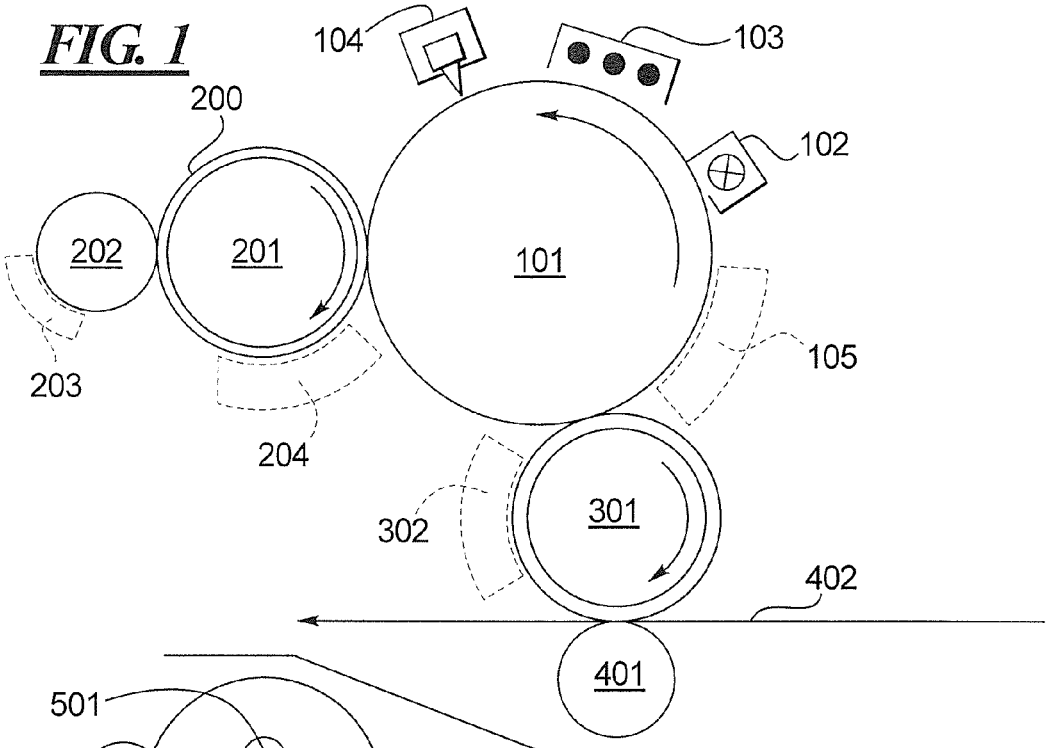
FIG. 1 is a principle representation of a printer or copier device with which the method can be implemented.

For the purposes of promoting an understanding of the principles of the invention, reference will now be made to a preferred embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The preferred embodiment specifies a novel fixing method for an electrographic printer or copier device. The device comprises an image-generating system that generates an electronic potential image (charge image) on a first potential image carrier (for example a photoconductor), which potential image is made visible via charged ink substance particles (toner particles) by means of a developer station (inking station) and is subsequently transferred (possibly via further intermediate image carriers such as, for example, transfer rollers, transfer belt) onto a recording medium (for example paper) and fixed on this.

In order to be able to implement a fixing according to the of the preferred embodiment method the usage of a liquid developer comprising a high-ohmic carrier fluid and toner particles is advantageous. The carrier fluid can exhibit a resistance of advantageously >=1010 ohm*cm and a boiling point of >100° C. A carrier fluid that fulfills these requirements can, for example, be based on silicone oil, whereby the silicone oil can comprise polydimethylsiloxane (PDMS) molecules, the silicone oil can comprise molecules derived from polydimethylsiloxane (PDMS) that can exhibit functional groups.

The liquid developer should exhibit a weight proportion of toner particles of advantageously 10 to 55%.

Further advantageous properties of the carrier fluid can be:

The developer fluid can exhibit a concentration of dispersion stabilizers in the range from 0.5 to 5%, advantageously >1% (a distinctly increased concentration relative to conventional liquid developers (that lie at <1%) therewith exists).

The toner particles can exhibit a reduced proportion of the carrier substance (conventionally resin) for bonding of the color pigments.

The bonding of the color pigments can occur optimized for stable and uniform charge capability while foregoing the low fusing temperature of the binding agent (resin) required in heat fixing.

When the liquid developer exhibits these properties, the fixing of the toner images on the recording medium can occur via cross-linking of the carrier fluid without the toner particles having to be melted. This occurs via polymerization of the carrier fluid and/or via addition of an auxiliary material and/or via effect of a small auxiliary energy. Since only the carrier fluid is drawn upon for fixing, the properties of the recording medium are insignificant for the fixing.

Furthermore, the polymerization reaction is advanced in a process-relevant time (<1 sec) so far that the toner image is securely bonded with the recording medium and a direct further processing of the recording medium can occur.

The polymerization reaction can be controlled such that the properties of the toner image can be adapted to different requirements; for example, resins, gloss can be adjusted.

The fixing according to the method of the preferred embodiment thus comprises the following particular features:

the fixing of the toner image at/on the recording medium occurs solely via cross-linking of the carrier fluid;

the excess carrier fluid not required for fixing of the toner image can be removed from the potential image carrier or intermediate carrier and/or recording medium;

the carrier fluid is transparent in the cross-linked state on the recording medium;

the toner particles are embedded in a fixed polymer matrix via the cross-linking of the carrier fluid, whereby the carrier fluid is permanently bonded with the recording medium;

the carrier fluid is hardened into a transparent film in the non-image regions;

the cross-linking of the carrier fluid can occur via:

reaction of radicals with the methyl groups of the PDMS;

polymerization: agglomeration of the carrier fluid molecules into polymer macromolecules via start reaction, chain growth and chain termination reaction;

polycondensation: connection of the carrier fluid molecules via reaction with functional groups of various types via separation of byproducts;

polyaddition: continuous addition of, respectively, two different molecule types without separation of byproducts.

Furthermore, the cross-linking reaction of the carrier fluid can be started or accelerated and/or its continuation can be enabled via one or more additional components:

An additional component can show the effect of a radiation or, respectively, radiation energy.

The radiation energy can be supplied in the form of heat.

The creation of free radicals can occur as a result of corona irradiation.

the additional components can exist in a gas (for example ozone) that acts on the developer fluid;

the gas can be combined with one of the aforementioned radiation energies, in particular the corona irradiation.

The additional components can be an increased humidity;

the increased humidity can be generated via vaporization, a spray strip etc.;

the increased humidity can be used in connection with the condensation-cross-linked carrier fluid;

the increased humidity can be combined with one of the aforementioned radiation effects.

The additional components can be a solid material or a fluid;

this solid material or this fluid can act as a reaction partner;

a catalyst can additionally be integrated into the component; the catalyst can comprise a bond with, for example, platinum, tin, titanium;

this solid material or this fluid can be combined with one of the aforementioned radiation effects;

the action of the reaction partner can only be generated via the combination with one of the aforementioned radiation effects.

the addition or, respectively, action of a component can occur at various points in the printing process;

the addition of the aforementioned radiation effects can occur after the development (according to the image) of a toner image, advantageously after the transfer onto the recording medium;

the effect of an increased humidity can occur after the development (according to the image) of a toner image, advantageously after the transfer onto the recording medium;

the admixture of a reaction partner into the circulation of the developer fluid can occur in the developer station;

admixture of a reaction partner can occur after the transfer onto the recording medium (for example after each print module) and in fact via a spray strip;

via a roller application unit.

In the event that the component is a solid material or a fluid, the recording medium can be coated with this. This can occur:

offline with regard to the printing process;

inline with regard to the printing process, before the transfer of the toner image on to the recording medium.

A principle representation of an electrographic printing device results from FIG. 1. A potential image carrier 101 (for example a photoconductor drum) is initially exposed to a discharge exposure 102. The charging of the potential image carrier 101 subsequently occurs in a station 103. Potential images of images to be printed are generated on the potential image carrier 101 via exposure according to the image in the station 104. These potential images are developed in a developer station 200 by a liquid developer with the aforementioned properties. For this liquid developer is extracted from a developer reservoir 203 and supplied to an application roller 202. The application roller 202 conveys the liquid developer to an applicator roller 201 and this conveys the liquid developer to the potential image carrier 101. The applicator roller 201 is subsequently cleaned in the cleaning station 204.

Given the development of the potential images on the potential image carrier 101, carrier fluid with toner particles migrates to the potential image carrier 101 and deposits there in the image regions; carrier fluid is transferred to the potential image carrier 101 in the non-image regions. A film that comprises carrier fluid with toner particles in the image regions, carrier. Carrier fluid in the non-image regions thus forms on the potential image carrier 101.

With an intermediate carrier 301 the film is transferred onto a recording medium 402 in the transfer printing station. Another counter-pressure roller 401 is used for this. The intermediate carrier 301 can additionally be cleaned with the aid of an intermediate carrier cleaning 302.

Figure 2:
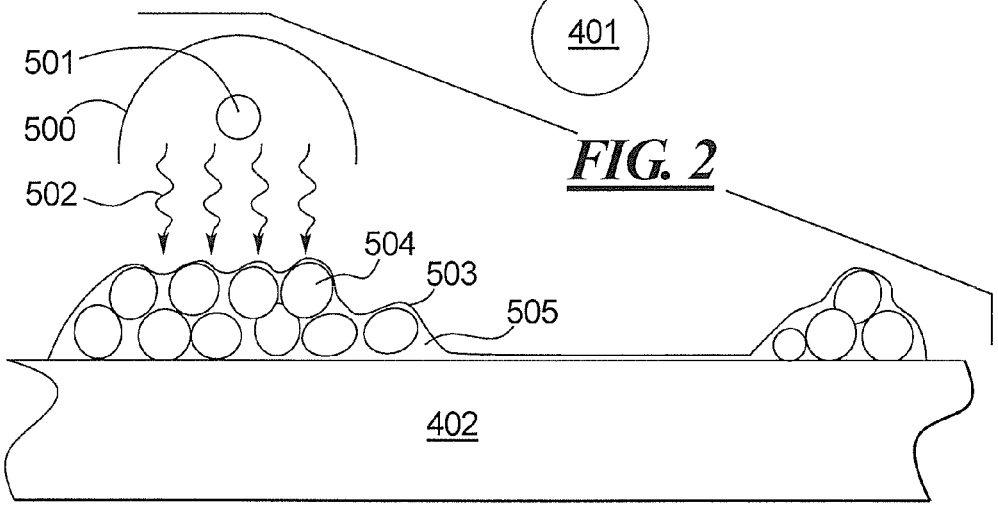
FIG. 2 shows the fixing of toner images in principle representation.

The recording medium 402 is finally supplied to a fixing station 500 in which the fixing occurs according to the method stated above. The workflow of the fixing results from FIG. 2. The fixing station 500 comprises a radiation source 501 that emits radiation 502 as auxiliary energy. The radiation 502 is directed onto the recording medium 402 and there impinges on the film 503 that comprises the print images. The film 503 comprises the toner particles 504 and the carrier fluid 505. Via the radiation 502 the film 503 is connected with the recording medium 402 according to the method illustrated above, meaning that the carrier fluid 505 is cross-linked; however, the toner particles 504 are not melted.

Figure 3:
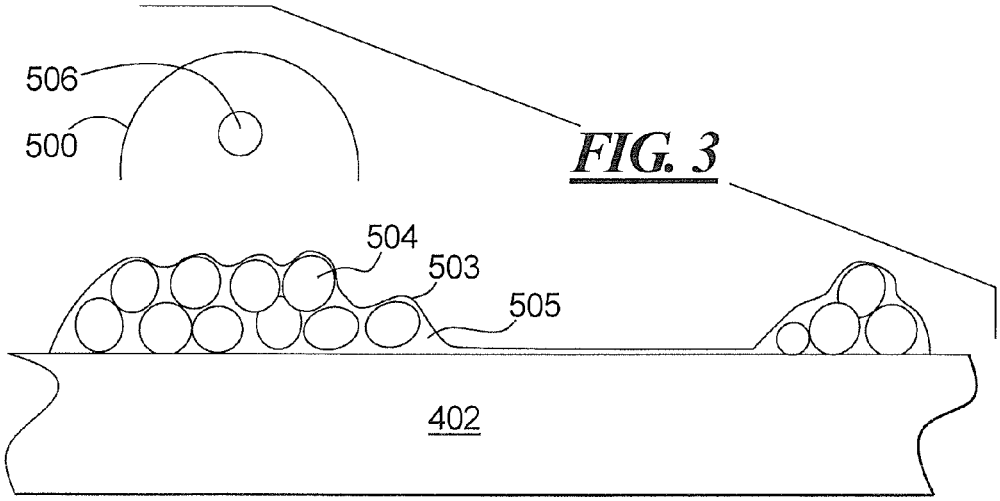
FIG. 3 is a further possibility for fixing of toner images.

In a second realization according to FIG. 3 a corona radiation is used as auxiliary energy. The fixing station 500 here comprises a corona radiation source 506 whose radiation is directed onto the recording medium 402. The carrier fluid 505 is cross-linked and solidified with the aid of the radiation, whereby the toner images 504 are fixed on the recording medium 402. The toner particles 504 are thus not melted.

In summary, the development of the potential images thus runs according to the following:

- In the region of the developer gap between potential image carrier and application roller the charged toner particles dispersed in the carrier fluid pass completely (or, respectively, nearly completely) into the image regions on the potential image carrier and are deposited there.
- After leaving the developer gap no (or, respectively, almost no) toner particles remain deposited in the non-image regions.
- The transfer from potential image carrier via possible further intermediate carriers (for example transfer roller, transfer belt) to the recording medium occurs via mechanical contact and/or via electrostatic assistance.
- Given each transfer step the carrier fluid is proportionally split between the potential image carrier and possible subsequent intermediate carriers (this applies up to the recording medium), whereby the division into image and non-image regions occurs.

When excess carrier fluid on the recording medium or an intermediate carrier should be removed, this can occur in the following manner:

- via a conditioning roller that is located in contact with the intermediate carrier and/or recording medium,
- via a conditioning roller
- to which potential is applied such that the charged toner particles are repelled from it and only the carrier fluid is split up;
- the carrier fluid transferred onto a non-absorbent conditioning roller can, for example, be removed by a scraper;
- if the roller comprises an absorbent coating, the transferred carrier fluid can, for example, be removed via a nip bar.

The cross-linking of silicone-based carrier fluids can occur in the following ways:

- via use of radicals:
  - the radicals react with the methyl groups of the PDMS such that a cross-linking arises via oxidization with peroxy bonds.
- via formation of silicone rubber (caoutchouc):
  - via wide-meshed cross-linking of the organic side groups of the silicone chains as a result of chemical bonds.
- via polymerization:
  - acid-catalyzed or via KOH; absence of chain-breaking substances (Me3SiO—) or cross-linking groups (MeSi(—O-)3), amplification via pyrogenous silicone dioxide.
- via oxidative cross-linking (vulcanization):
  - via benzyl peroxide and heating;
  - at room temperature via small, controlled quantities of Si—H groups that can be catalytically added to previously-added Si—CH═CH2 groups;
  - via cross-linking of single-component silicone rubber with acetoxy groups via action of moisture at room temperature.
- via heat cross-linked (addition cross-linked) silicone:
  - these comprise 1- or 2-component systems with, for example, platinum as a catalyst, whereby the reaction runs without separation of byproducts; the vulcanization time in 1- and 2-component systems is dependent on the temperature.
- condensation cross-linked silicone:
  - they comprise 1- or 2-component systems with, for example, tin as a catalyst and humidity for cross-linking. Byproducts are generated during the reaction. The vulcanization time in 2-component systems is dependent on the catalyst (accelerator) and, in 1-component systems, on the air moisture, thickness of the layer and the temperature.
- via formation of silicone resins:
  - they are achieved via spatial cross-linking of the siloxane scaffold.
- via polycondensation:
  - via hydrolysis of phenyl-substantiated dichloro- or trichlorosilane in toluene; removal of HCl with water and partially-controlled polymerization. Final linking into 3-dimensional siloxane scaffolds is achieved via heating in the presence of a heavy metal catalyst or quaternary ammonium catalyst and condensation of the silanol group.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim as our invention:

1. A method for printing of a recording medium, comprising the steps of:

generating potential images of images to be printed on a potential image carrier;

developing the potential images into an image film comprising image regions and non-image regions on the potential image carrier via application of a liquid developer comprising polymerizable carrier fluid of silicone oil with dye particles suspended therein;

transferring the image film onto the recording medium;

fixing the image film on the recording medium via a cross-linking reaction of the silicone oil such that the dye particles of the image regions are embedded in a fixed polymer matrix and the silicone oil hardens into a transparent film that permanently bonds with the recording medium; and starting, accelerating, or extending the cross-linking reaction of the silicone oil by at least two components comprising radiation plus increased humidity.

2. A method according to claim 1 in which the increased humidity is generated via vaporization or a spray strip.

3. A method according to claim 1 in which the increased humidity is used in connection with a condensation-cross-linked carrier fluid.

4. A method according to claim 1 in which the addition of increased humidity occurs after the development of the toner image.

5. A method according to claim 1 in which the radiation is supplied in the form of heat.

6. A method according to claim 1 in which the radiation acts via corona irradiation.

7. A method according to claim 1 in which a gas acts on the carrier fluid as an additional component in addition to said increased humidity.

8. A method according to claim 1 in which a solid material or a fluid that acts as a reaction partner is used as an additional component in addition to said increased humidity.

9. A method according to claim 8 in which a catalyst that comprises a bond with platinum, tin, or titanium is used as said additional component.

10. A method according to claim 1 in which the components are combined with one another.

11. A method according to claim 1 in which the components act on the carrier fluid at different points in the printing process.

12. A method according to claim 1 in which the silicone oil is hardened into the transparent film in the non-image regions.

13. A method according to claim 1 in which the silicone oil comprises polydimethylsiloxane.

14. A method according to claim 1 in which the silicone oil comprises molecules derived from polydimethylsiloxane that exhibit functional groups.

15. An electrographic printer or copier device, comprising:

an imager to generate potential images on a potential image carrier;

a developing station which develops the potential images into an image film comprising image regions and non-image regions on the potential image carrier via application of a liquid developer comprising a polymerizable carrier fluid of silicone oil with dye particles suspended therein;

a transfer station at which the image film is transferred onto a recording medium; and a fixing station where the image is fixed on the recording medium via a cross-linking reaction of the silicone oil such that the dye particles of the image regions are embedded in a fixed polymer matrix and the silicone oil hardens into a transparent film that permanently bonds with the recording medium, and wherein the cross-linking reaction of the silicone oil is started, accelerated, or extended by at least two components comprising radiation plus increased humidity.

16. An electrographic printer or copier device of claim 15 in which the increased humidity is generated via vaporization or a spray strip.

17. An electrographic printer or copier device of claim 15 in which the increased humidity is used in connection with a condensation-cross-linked carrier fluid.

18. An electrographic printer or copier device according to claim 15 wherein a gas acts on the carrier fluid as an additional component in addition to said increased humidity.

19. An electrographic printer or copier device according to claim 15 wherein a solid material or a fluid that acts as a reaction partner is used as an additional component in addition to said increased humidity.

20. An electrographic printer or copier device, comprising:

an imager to generate potential images on a potential image carrier;

a developing station which develops the potential images into an image film comprising image regions and non-image regions on the potential image carrier via application of a liquid developer comprising a polymerizable carrier fluid of silicone oil with dye particles suspended therein;

a transfer station at which the image film is transferred onto a recording medium; and a fixing station where the image is fixed on the recording medium via a cross-linking reaction of the silicone oil such that the dye particles of the image regions are embedded in a fixed polymer matrix and the silicone oil hardens into a transparent film that permanently bonds with the recording medium, and wherein the cross-linking reaction of the silicone oil is started, accelerated, or extended by at least two components comprising radiation plus increased humidity.

* * * * *